US007251910B1

(12) United States Patent
Ming

(10) Patent No.: US 7,251,910 B1
(45) Date of Patent: Aug. 7, 2007

(54) ELECTRICAL DISPLAY DEVICE WITH INDIVIDUAL DISPLAY MEMBERS

(75) Inventor: Tsang Chiu Ming, Kwai Chung (KR)

(73) Assignee: General-Tech Holdings Limited, Kwai, Chung (HK)

( * ) Notice: Subject to any disclaimer, the term of this patent is extended or adjusted under 35 U.S.C. 154(b) by 376 days.

(21) Appl. No.: 10/696,707

(22) Filed: Oct. 29, 2003

Related U.S. Application Data

(63) Continuation-in-part of application No. 10/624,343, filed on Jul. 22, 2003.

(51) Int. Cl.
*G09F 13/04* (2006.01)

(52) U.S. Cl. ..... 40/576; 362/216; 362/219; 40/545

(58) Field of Classification Search ..... 40/545, 40/552, 576; 345/34, 42, 47; 362/216, 219, 362/249, 231, 252; 315/185 R, 185 S, 312
See application file for complete search history.

(56) References Cited

U.S. PATENT DOCUMENTS 5,203,626 A * 4/1993 Clement ..... 362/250
5,436,813 A * 7/1995 Gonzalez ..... 362/216
6,305,110 B1 * 10/2001 Chang ..... 40/576
6,478,450 B1 * 11/2002 Grajcar ..... 362/249

FOREIGN PATENT DOCUMENTS

WO WO 94/21014 * 9/1994

* cited by examiner

*Primary Examiner*—Wilson Lee
(74) *Attorney, Agent, or Firm*—G. Brian Pingel; Camille L. Urban

(57) ABSTRACT

An electrical neon display device that allows for the interchangeability of the material being displayed and includes a power track, a track head and at least one display member that is electrically connected to said track head and includes a neon tube that is preferably shaped in the configuration of a desired letter or design to be displayed by said device.

20 Claims, 15 Drawing Sheets

ELECTRICAL DISPLAY DEVICE WITH INDIVIDUAL DISPLAY MEMBERS

This is a Continuation-In-Part of application Ser. No. 10/624,343 filed Jul. 22, 2003, is now allowed.

BACKGROUND OF THE INVENTION

1. Field of the Invention

The present invention relates in general to electrical display signs that preferably include neon display elements and more specifically relates to a display sign that displays individual letters or designs and allows for the interchangeability of the letters or designs being displayed.

2. Description of the Prior Art

During at least the last decade, a form of electrical lighting commonly referred to as "track lighting" has become highly popular not only in commercial situations but also in residential environments. Typically, track lighting systems are formed with an H-track power strip into which are plugged incandescent or halogen light bulbs. Although the use of a variety of lighting systems that employ neon bulbs is well-known, up to this time neon bulbs have not been employed with track lighting systems.

It is also well-known in the art to use neon signs for use as exterior signage on buildings or advertising media to promote a business. Typical neon signs employ relatively expensive neon tubing that is generally formed in one piece to provide lighting for the display. Such neon signage not only is highly expensive, but is also difficult to produce or replace. Accordingly, the present invention is designed to provide a neon light display that preferably includes a plurality of individual lighting members.

SUMMARY OF THE INVENTION

The present invention provides an electrical neon display device that allows for the interchangeability of the display members employed in the device and includes an alternating current power track, a track head electrically connected to the power track, and at least one display member that is electrically connected to the track head.

The track head of the display device is semi-permanently electrically connected to the power track to permit removal of the device therefrom for substitution with another display device. The track head serves as a housing for a transformer that converts alternating current received from the power track into direct current. Additionally, each display member includes a neon tube that serves as a source of light and will preferably be in the shape of a letter or design so that the display device can be used as signage for promoting a business or other activity.

The foregoing and other advantages of the present invention will appear from the following description. In the description, reference is made to the accompanying drawings, which form a part hereof, and in which there is shown by illustration and not of limitation specific forms in which the invention may be embodied. Such embodiments do not represent the full scope of the invention, but rather the invention may be employed in a variety of other embodiments and reference should be made to the claims herein for interpreting the breadth of the invention.

DETAILED DESCRIPTION OF THE PREFERRED EMBODIMENT

Figure 1:
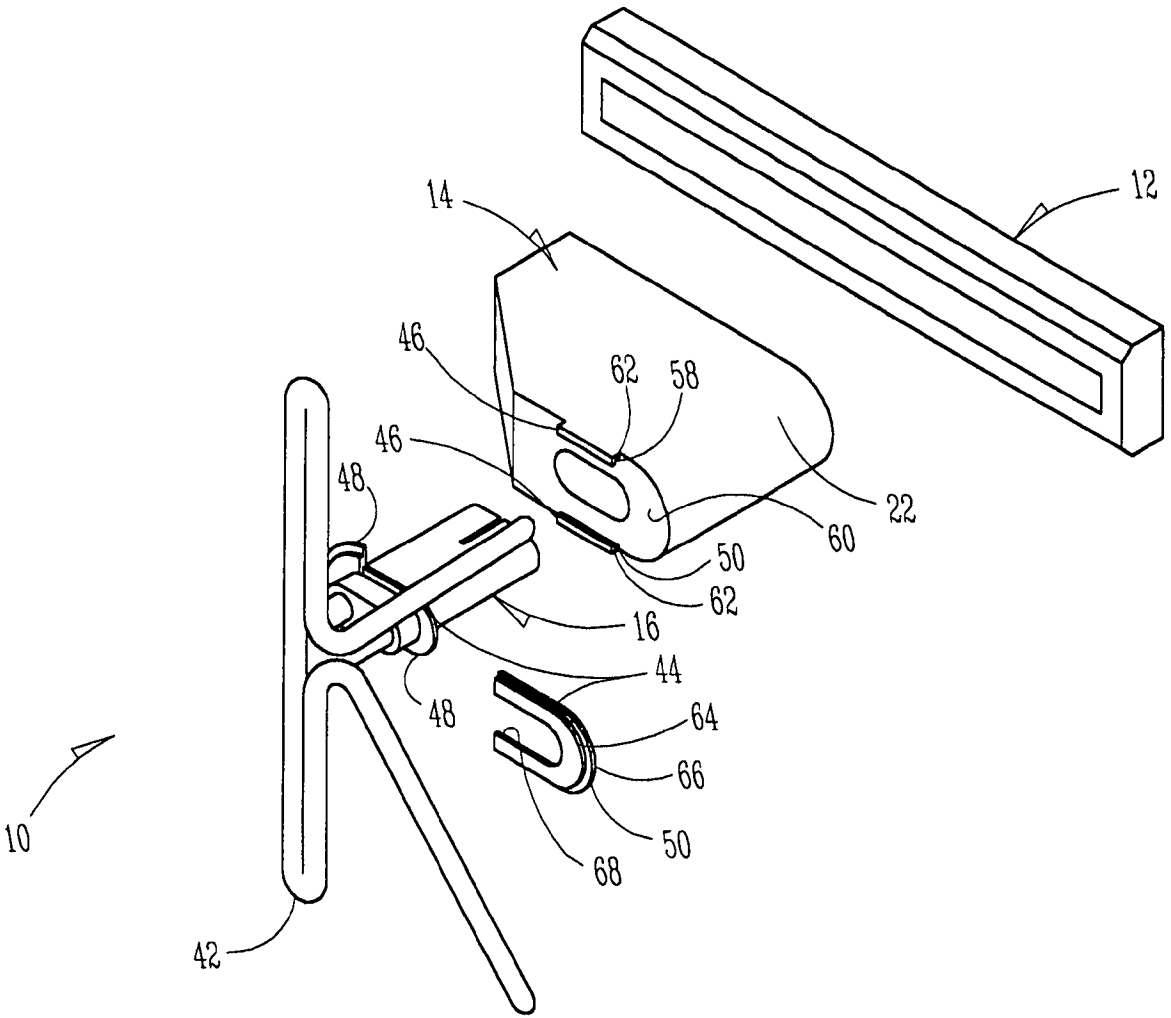
FIG. 1 is a front perspective view of a first embodiment of a neon display device of the present invention that includes a power track, a track head, and a display member shown in an exploded relationship.

Referring now to the drawings and with reference first to FIG. 1, a perspective view of a first preferred embodiment of an electrical neon display device of the present invention is shown at 10 that can be utilized in typical fashion as a track lighting display, but preferably is designed to be utilized as a display sign.

The device 10 includes a source of alternating current electrical power in the form of a standard type "H" track 12, a track head 14, and a display member 16 in the form of the letter K. The dimensions of the power track 12 are not essential to the present invention as the track will be chosen in length to accommodate the number of track heads that are to be utilized in the device 10. Similarly, the "K" shape of the display member 16 is solely for the purpose of illustration as it is envisioned that the member 16 can be formed in almost any shape as desired.

Figure 2:
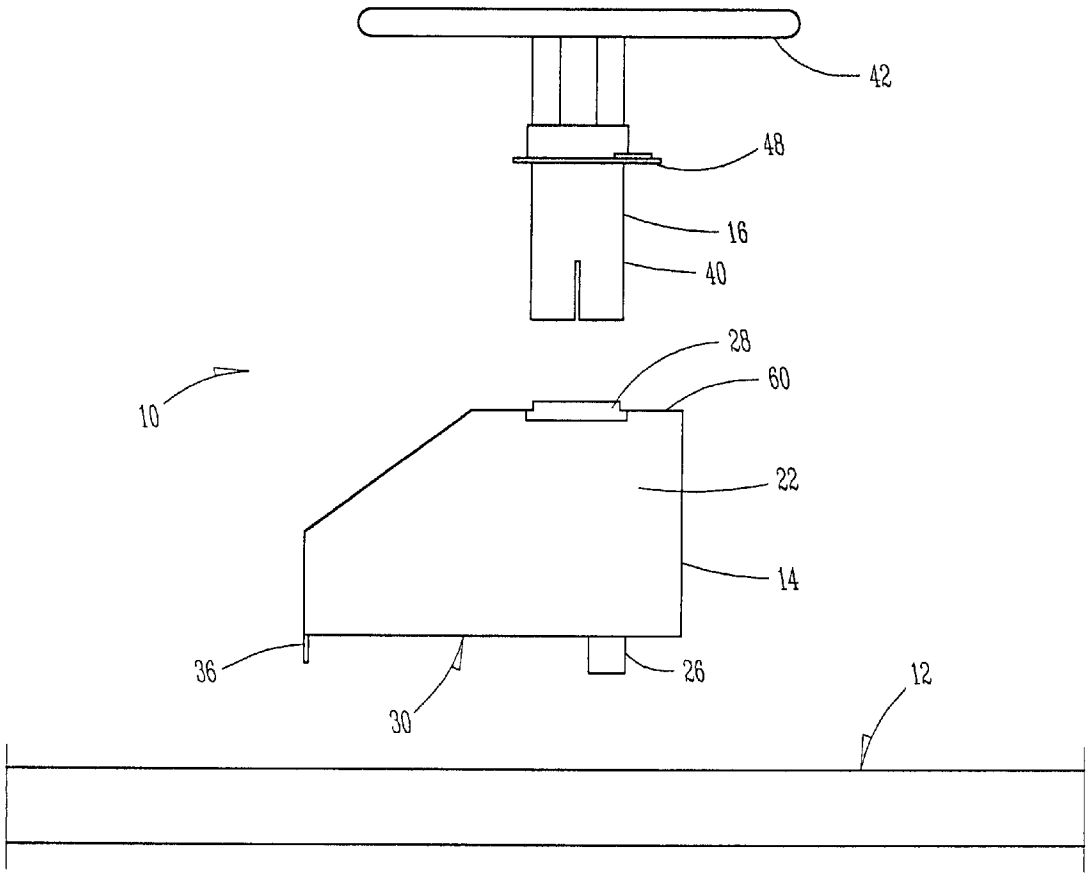
FIG. 2 is a side view in elevation of the embodiment shown in FIG. 1.
Figure 3:
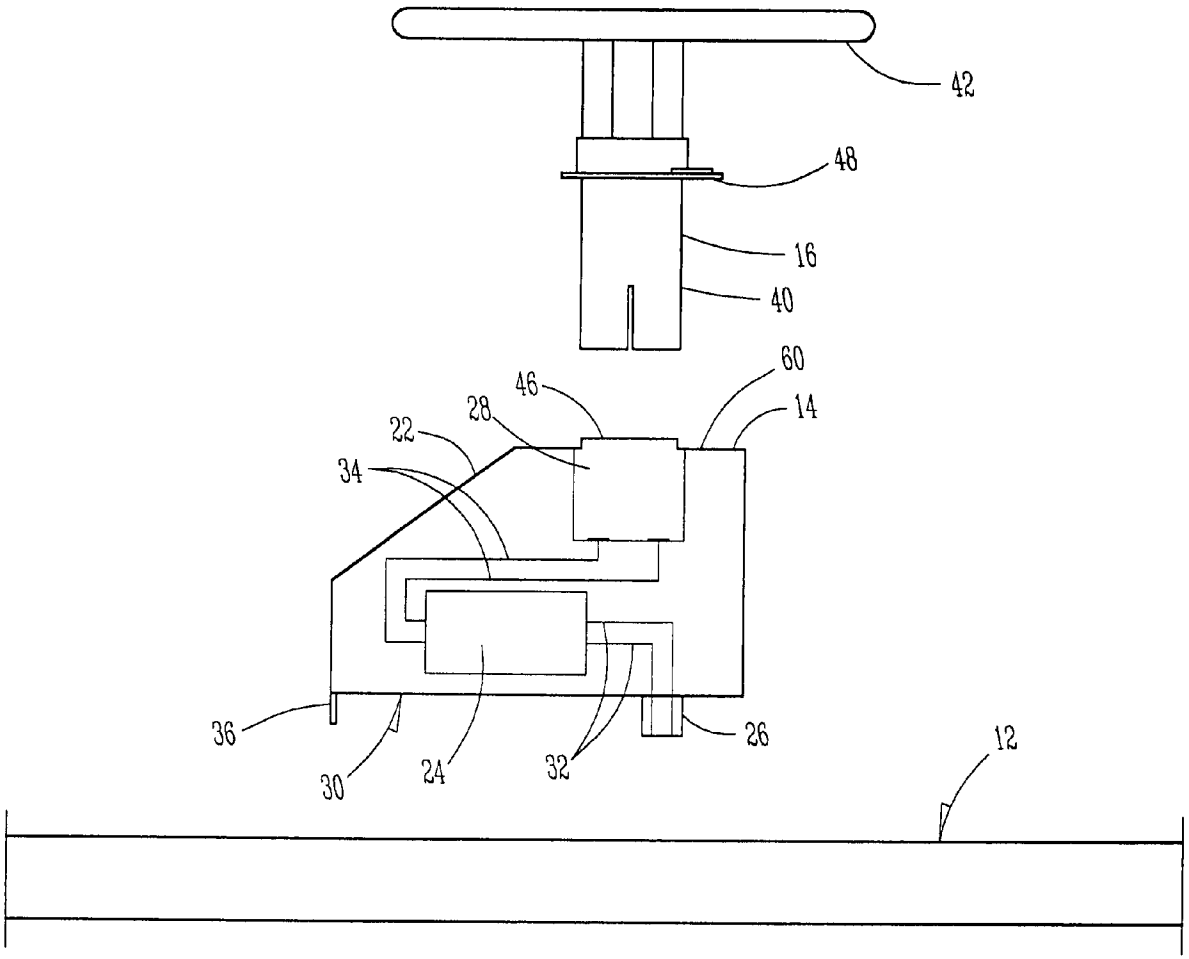
FIG. 3 is a side view in elevation similar to that of FIG. 2 but showing the internal components of the track head.

Referring now to FIGS. 1, 2, and 3, which illustrate a first embodiment of the present invention, the track head 14 has a body portion 22 that serves as a relatively narrow housing for a transformer 24 (see FIG. 3) and electrical connectors 26 and 28. The electrical connector 26 is fixed to a bottom 30 of the track head body 22 and is in the form of a standard type electrical connector designed to coact with and electrically contact the power track 12 as is well-known in the art. The electrical connector 26 is an electrical contact with the transformer 24 via conductors 32. Thus, the alternating current received from the power track 12 is supplied to the transformer 12 and is converted into DC power, which is then supplied by conductors 34 to the electrical connector 28 that preferably is in the form of a female connector.

It should be recognized by those skilled in the art that the specific form of the electrical connector 28 is not critical to the present invention and may alternatively be a male connector. The shape of the track head body 22 is also not critical to the present invention and the particular shape shown has been selected so that the transformer 24 and connectors 26 and 28 are easily accommodated within the body 22. Also, it is preferable that at least a portion of the bottom 30 of the body 22 be removable for replacement of the transformer, if needed, and that the bottom 30 also have an outwardly projecting tab 36 that acts to maintain the track head 14 in alignment with the track 12.

The display member 16 is formed of a male connector 40 on which is mounted a neon tube 42. Although as mentioned above, the tube 42 is in the shape of a K, it is contemplated that the tube 42 can be formed in a variety of shapes not only to provide lighting, if only lighting is desired, but also can be in the shape of letters or designs for use as a display sign for a business or attraction.

The male electrical connector 40 is of a shape and size to mate with the female connector 28 of the track head 14. In this first embodiment, the track head 14 and the display member 16 are semi-permanently joined together through the use of connecting means 44 formed by a pair of spaced apart ledges 46 on the top of the electrical connector 28, a flange assembly 48 located near the top of the connector 40, and a latch member 50 that is designed to coact with the ledges 46 and the flange assembly 48.

Figure 7:
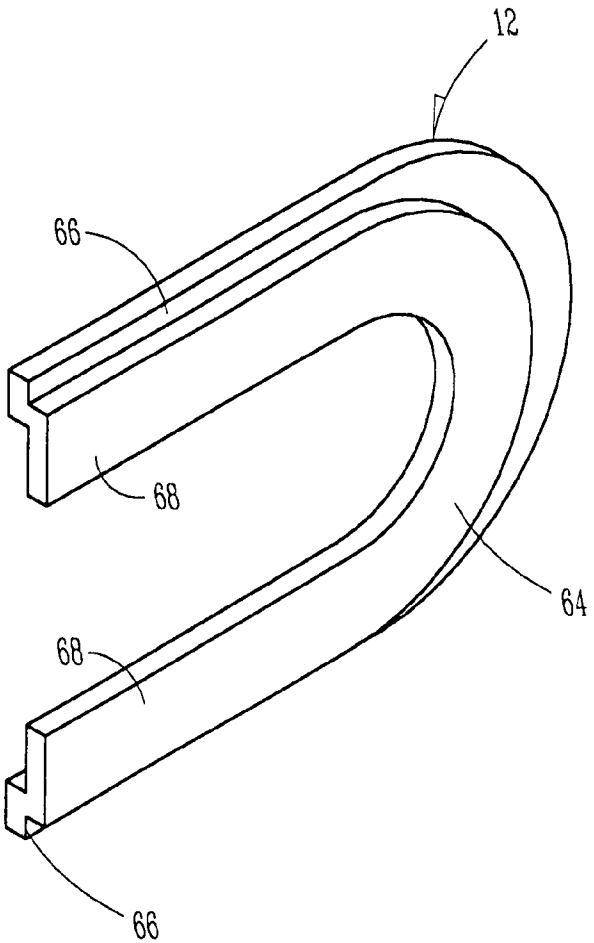
FIG. 7 is a perspective view of a latch member.

As best shown in FIG. 1, the ledges 46 on the track head 14 are each formed with a curved configuration so that their upper ends 58 are generally parallel to an upper surface 60 of the track head 14 to provide recesses 62 for a purpose to be described below. Referring to FIG. 7, the latch member 50 is designed to coact with the ledges 44 and is formed with a generally U-shaped rail type structure 64 having somewhat of a "Z" shaped cross section to provide a lower flange structure 66 that is outwardly extending and an upper flange structure 68 that is inwardly extending.

To connect the display member 16 to the track head 14, the electrical connector 40 is positioned into the connector 28 until the connector flange assembly 48 lies flat against the upper surface of the connector 28. The latch member 50 is then slid into position with its lower flange structure 66 located in the recesses 62 formed by the ledges 46 and the upper flange structure 68 overlying the display member flange assembly 48. In this manner, the latch member 50 is held in position on the track head 14 by the ledges 46, and the latch member 50 in turn holds the display member 16 in position by means of its upper flange structure 68. As can be readily recognized, assembly of the track head 14 and display member 16 is readily accomplished through the use of the latch member 50 so that substitution of the display member 16 with another display member 16 can be readily and easily accomplished.

Figure 4:
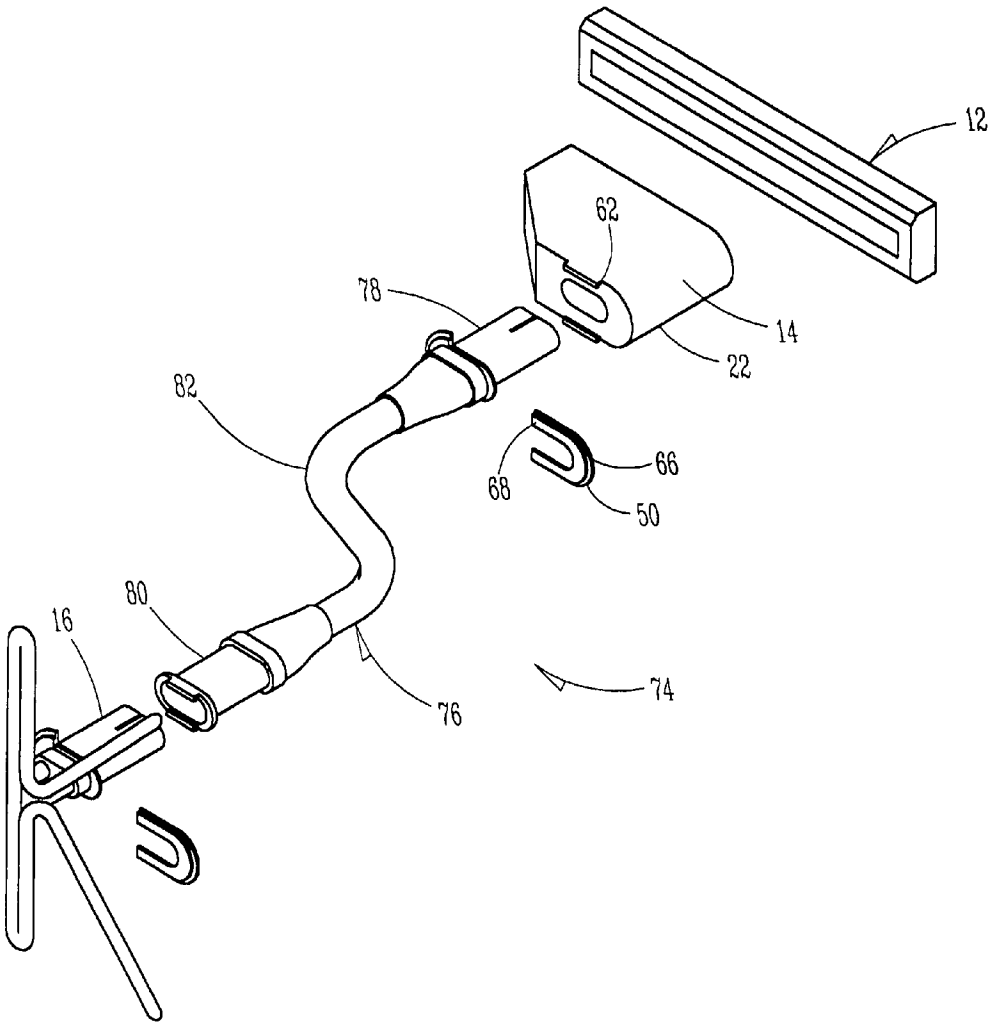
FIG. 4 is a perspective view of a second embodiment of the present invention that is similar to the first embodiment but includes an extension member.
Figure 5:
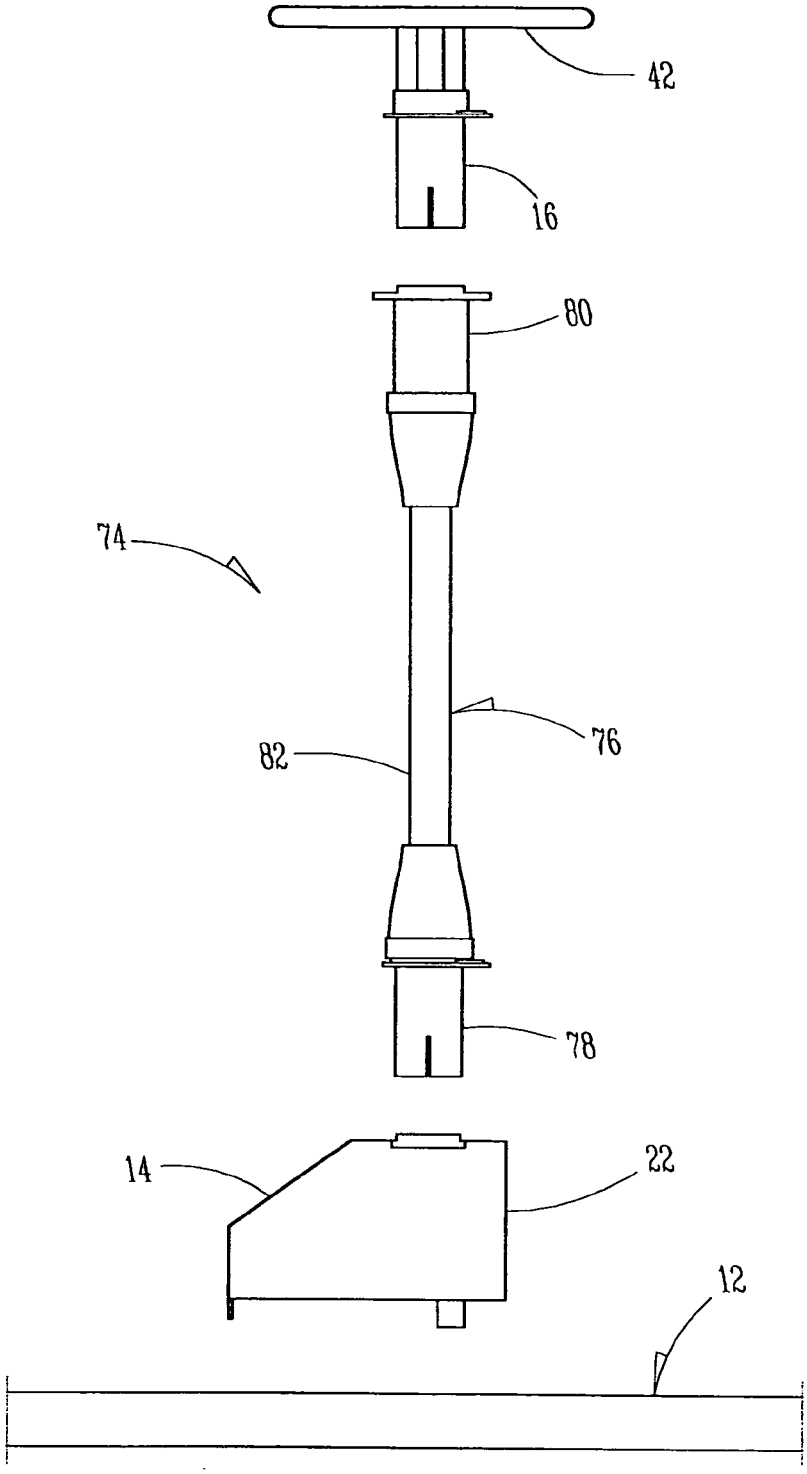
FIG. 5 is a side view in elevation of the embodiment of FIG. 4.
Figure 6:
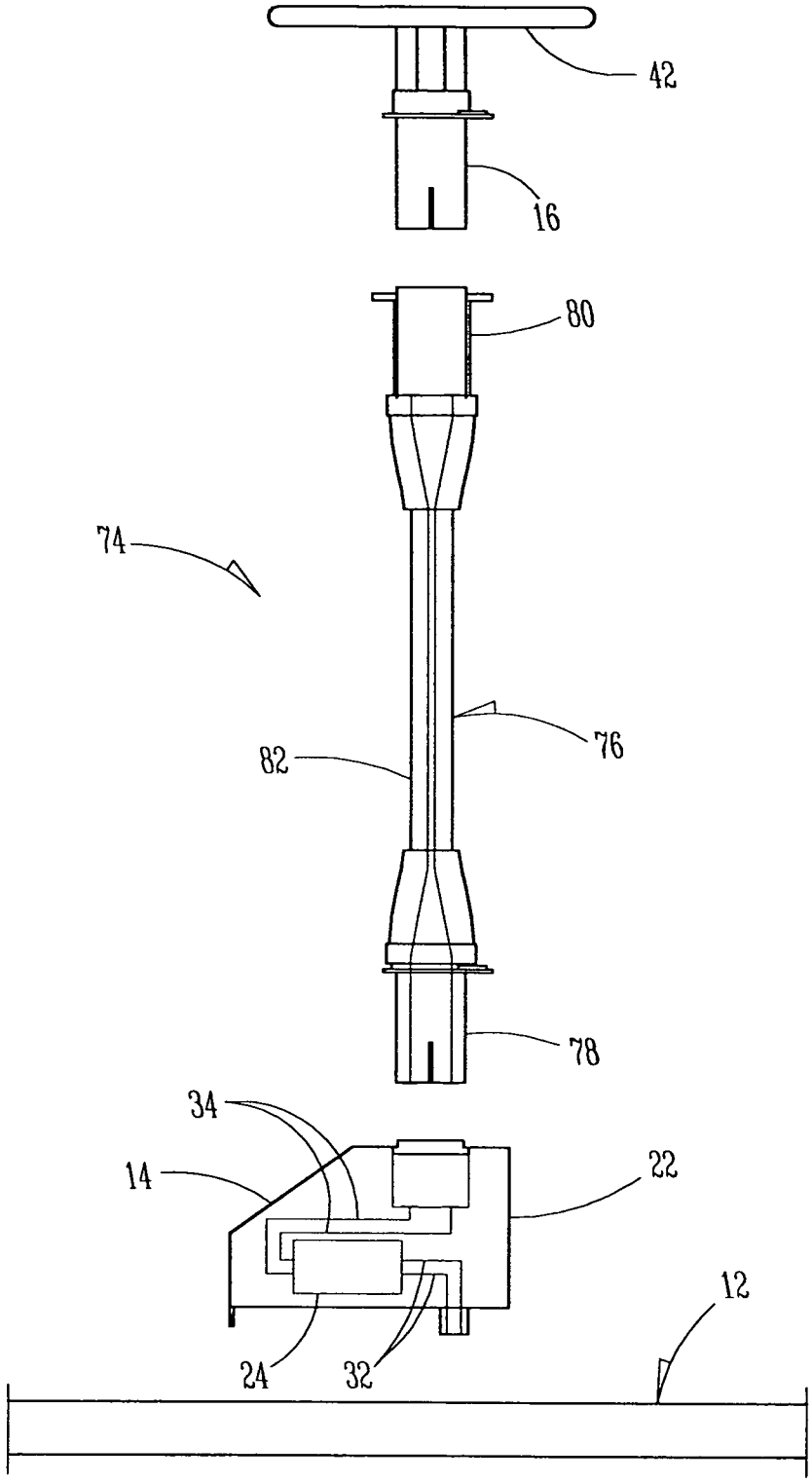
FIG. 6 is a side view in elevation similar to that of FIG. 5, but showing the internal components of the track head and extension member.

Referring now to FIGS. 4, 5 and 6, a second embodiment of the electrical display device of the present invention is shown at 74 and as can be readily perceived is similar to the first embodiment 10 in that it includes the power track 12, the track head 14 and the display member 16. However, the second embodiment 74 differs from the first embodiment by having a display member extension arm 76 positioned between the track head 14 and display member 16.

The extension arm 76 includes, on one end, a male electrical connector 78 that is similar in structure to that of the connector 40 on the display member 28. The arm 76 further includes on the opposite end an electrical connector 80 that is similar in structure to that of the connector 28 on the track head 14. Interposed between the connectors 78 and 80 is a flexible tubing 82 that serves as a conduit for electrical wiring 84, see FIG. 6, that runs between the connectors 78 and 80.

The tubing 82, although being flexible, is somewhat rigid so that it can be bent to a particular configuration to locate one of its associated display member 16 as desired and will remain in such position until a different bending force is applied. Accordingly, by the use of the extension 76 a wide variety of display member placements can be achieved with the device 74.

As can be readily noted from the above description, the first two embodiments of the present invention have in common the characteristic that the power track 12, the track head 14, the display member 16 and the extension arm 76 all have the common characteristic that they are semi-permanently attached to one another. However, such method of attachment is not critical to the present invention and there are a variety of different combinations for securing these components together as will be illustrated by the following embodiments.

Figure 8:
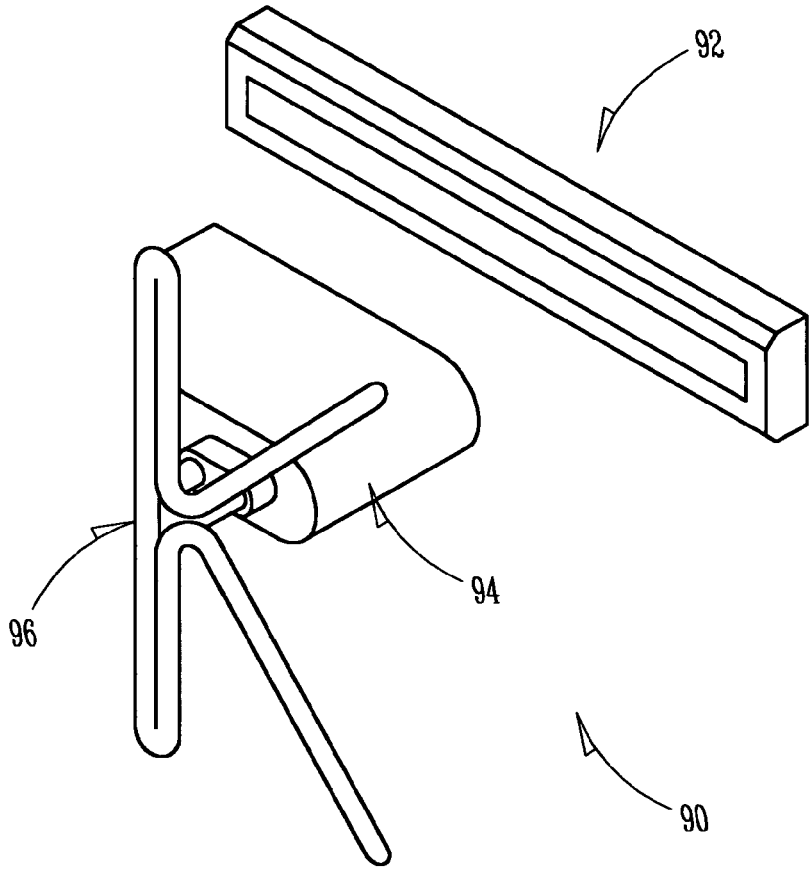
FIG. 8 is a front perspective view of a third embodiment of the present invention that is similar to the first embodiment but with the track head and display member in a fixed relationship.
Figure 9:
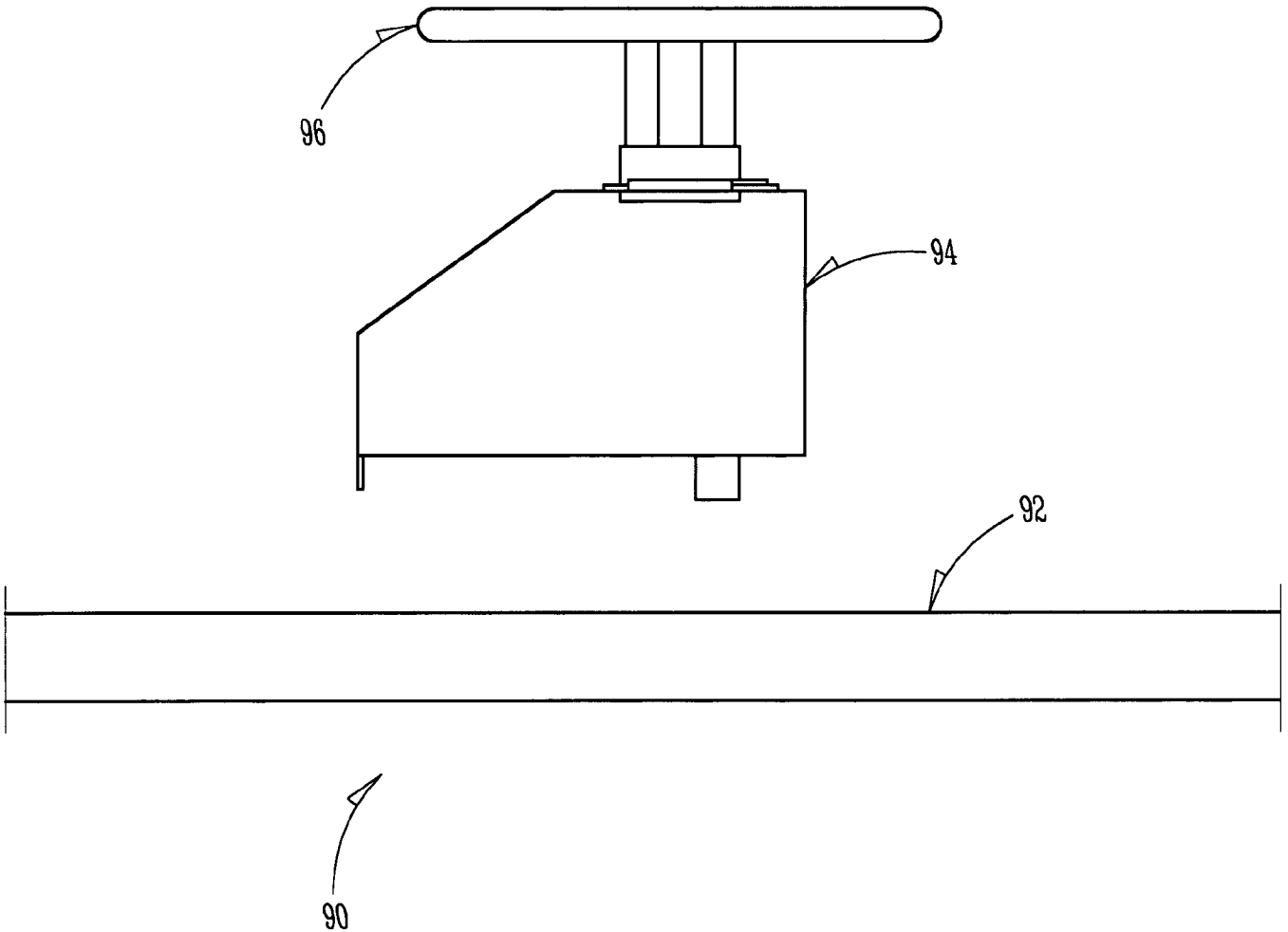
FIG. 9 is a side view in elevation of the embodiment of FIG. 8.

Referring now to FIGS. 7 and 8, a third embodiment of the present invention is shown at 90. Similar to the display device 10, the device 90 is formed of a power track 92, a track head 94 and a display member 96. However, the device 90 differs from the device 10 in that the display member 96 is fixed to the track head 94 and is not designed for ready removal therefrom. Accordingly, if for some reason it is desired to change the form of the display member 96, the track head 94 and display member 96 are removed as a unit from the power track 92.

Figure 10:
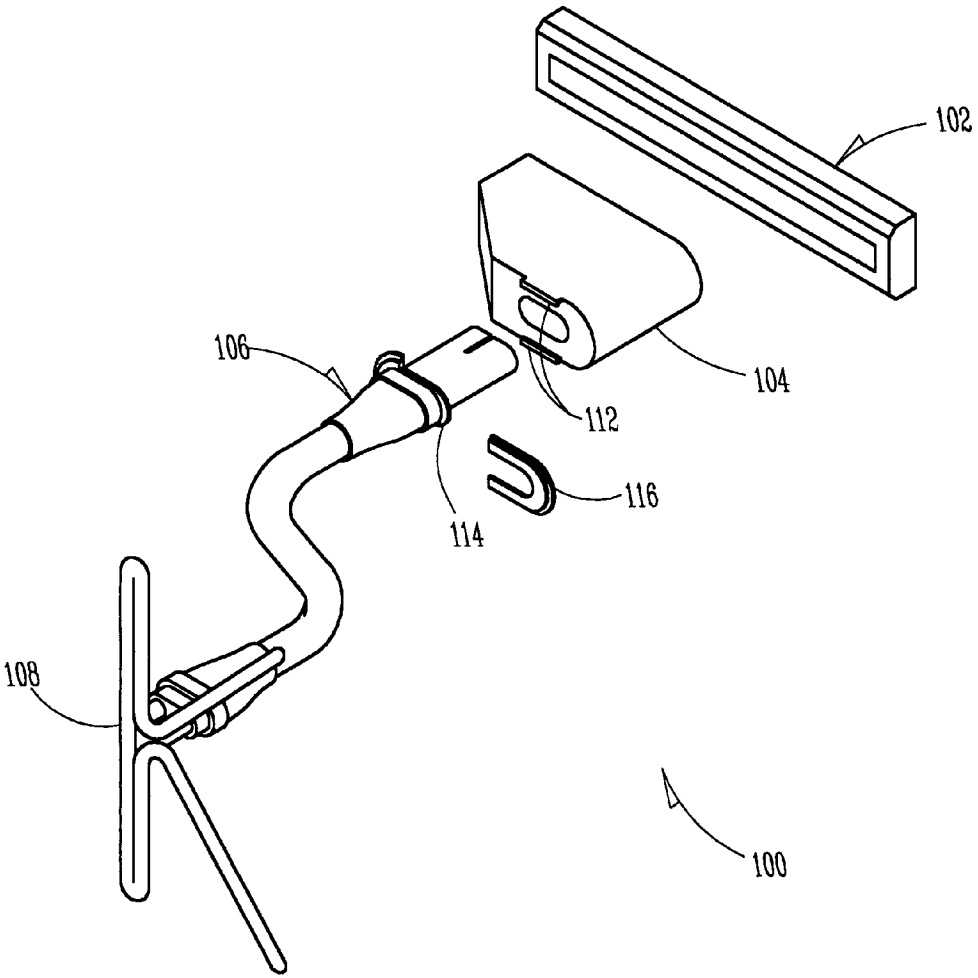
FIG. 10 is a front perspective view of a fourth embodiment of the present invention that is similar to the second embodiment but includes an extension member that is fixed to the display member.
Figure 11:
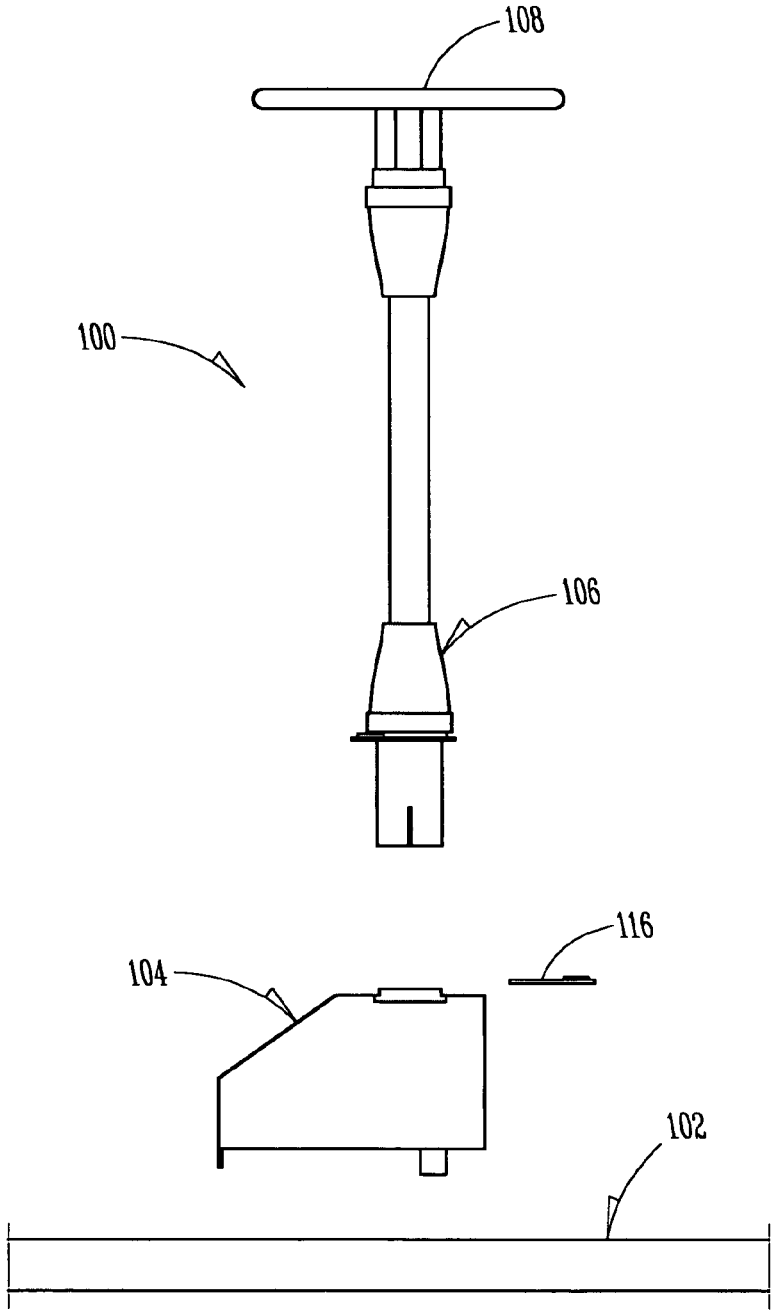
FIG. 11 is a side view in elevation of the fourth embodiment of FIG. 8.

In certain instances, it may also be preferable to have a similar type fixed relationship between the extension arm 76 the track head 14 and the display member 16. For example, referring now to FIGS. 10 and 11, a fourth embodiment of the present invention is shown at 100. Similar to the second embodiment 74, the display device 100 includes a power track 102, a track head 104, an extension member 106 and a display member 108.

As described with respect to the display device 74, the track head 104 is semi-permanently attachable to the power track 102. Likewise, one end of the extension member 106 is semi-permanently attachable to the track head 104 through the use of a connecting means 110 formed of spaced apart ledges 112 located on top of the track head 104, a flange assembly 114 formed on the lower, free end of the extension arm 106 and a latch member 116 that coacts with the ledges 112 and flange assembly 114 to semi-permanently connect the extension arm 106 to the track head 102.

In contrast to the construction of the second embodiment 74, the display member 108 and the outer end of the extension arm 106 are combined together in a unitary construction. Accordingly, if it is desired to change the display member 108, such change is accomplished by releasing the lower end of the extension arm 106 from the track head 104 so that the extension arm 106 and display member 108 can be removed therefrom as a unit.

Figure 12:
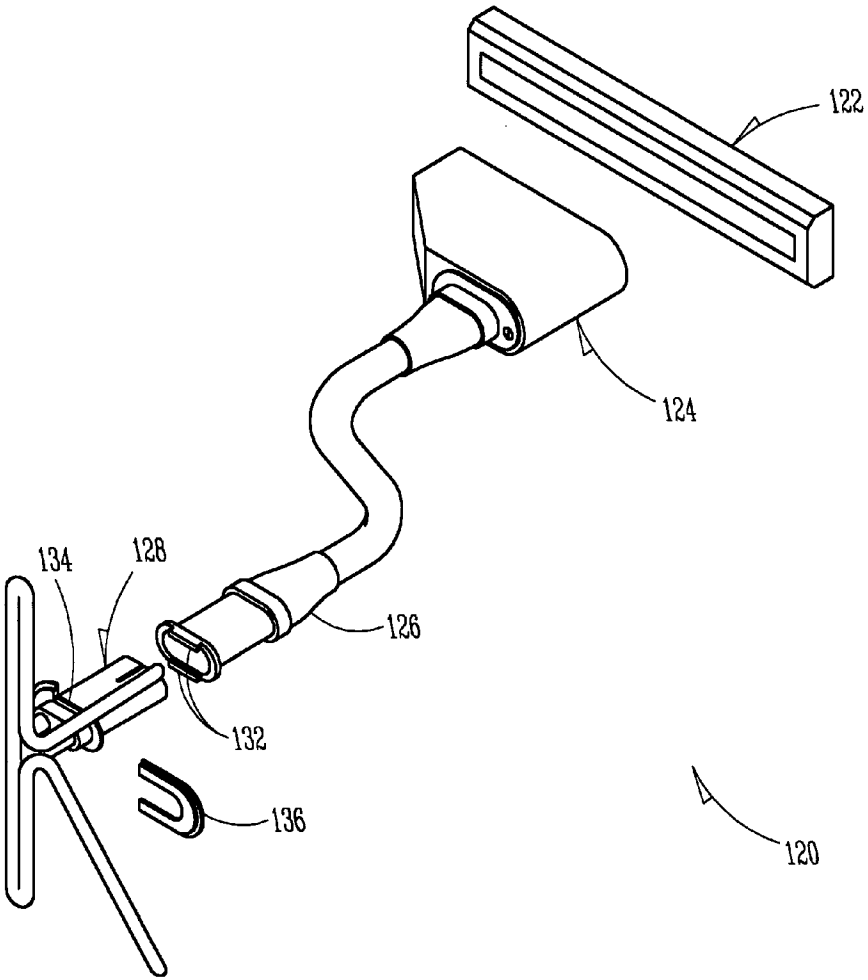
FIG. 12 is a front perspective view of a fifth embodiment of a neon display device of the present invention that is similar to that of the second embodiment except that the track head is fixed to the extension member.
Figure 13:
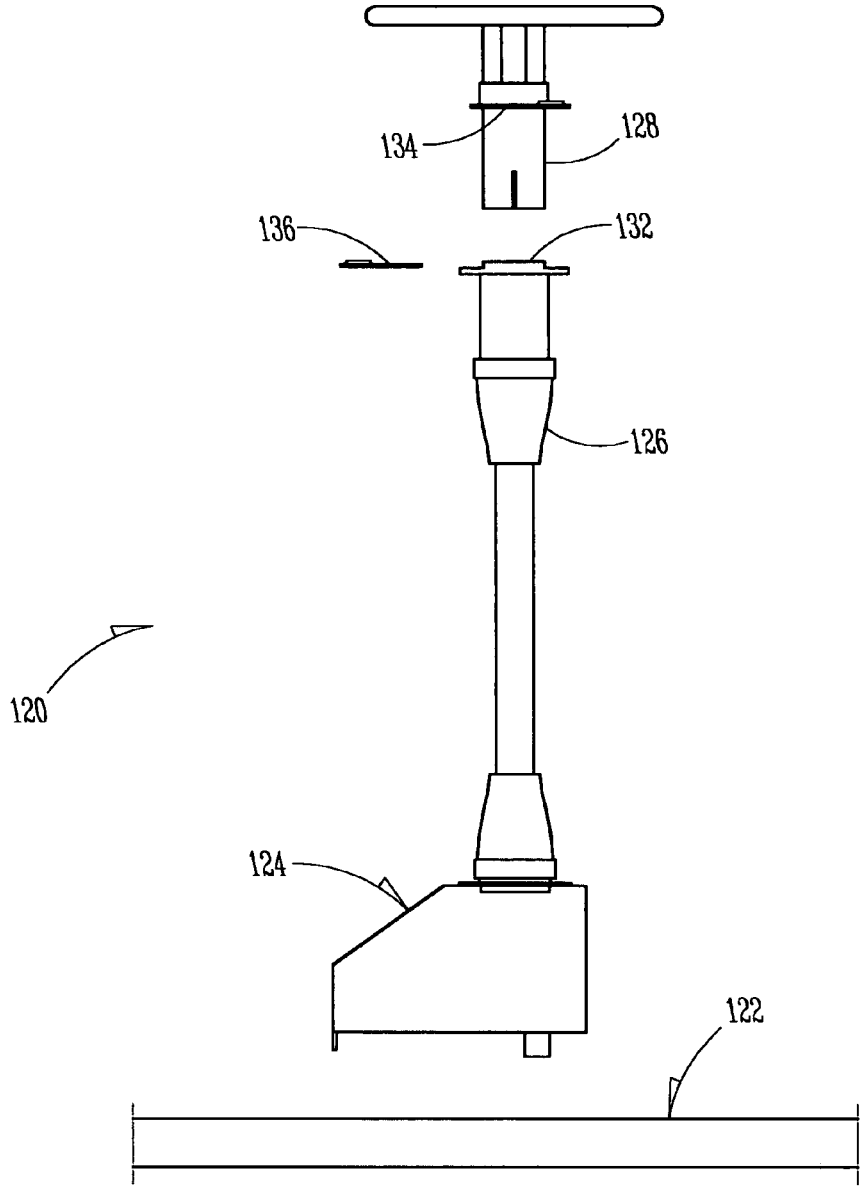
FIG. 13 is a side view in elevation of the fifth embodiment of FIG. 12.

Referring now to FIGS. 12 and 13, a fifth embodiment of the present invention is shown at 120 and again includes a power track 122, a track head 124, an extension arm 126 and a display member 128. In contrast to the fourth embodiment, the display member 128 and extension arm 126 are semi-permanently connected to one another whereas there is a fixed connection between the track head 124 and the extension arm 126. Similar to the semi-permanent connections between the components of the first four embodiments, the semi-permanent connection between the extension arm 126 and the display member 128 is formed by connecting means 130 that includes spaced apart ledges 132 on the lower end of the extension arm 126, a flange assembly 134 on the display member 128 and a latch member 136 similar to that described above.

Figure 14:
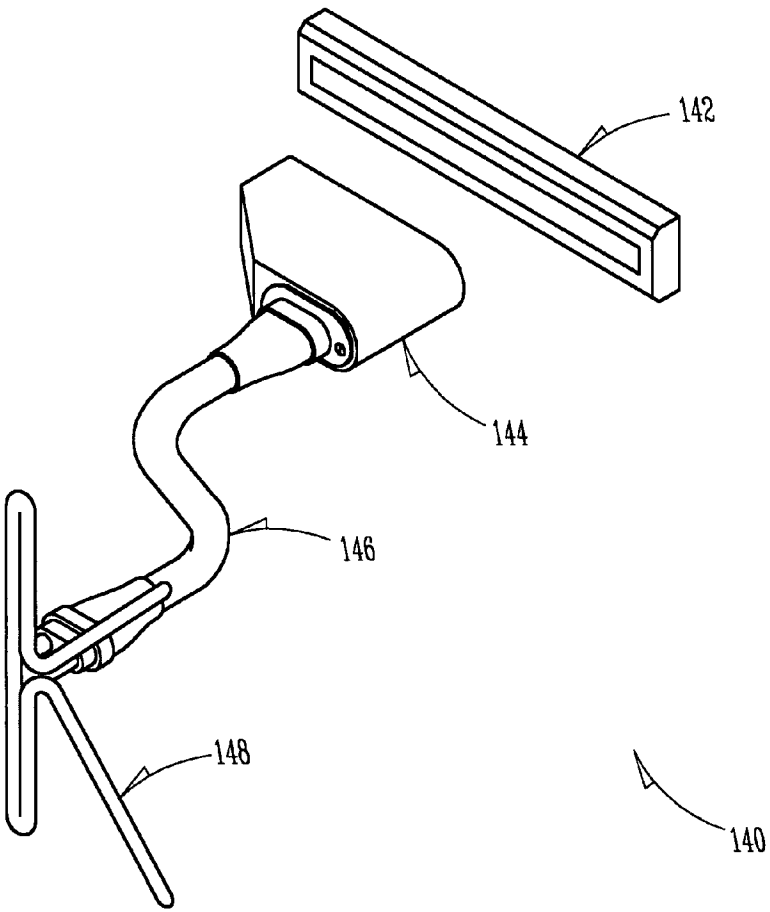
FIG. 14 is a perspective view of a sixth embodiment of the present invention that is similar to the second embodiment but having the track head, extension member and display member in a fixed relationship with one another.
Figure 15:
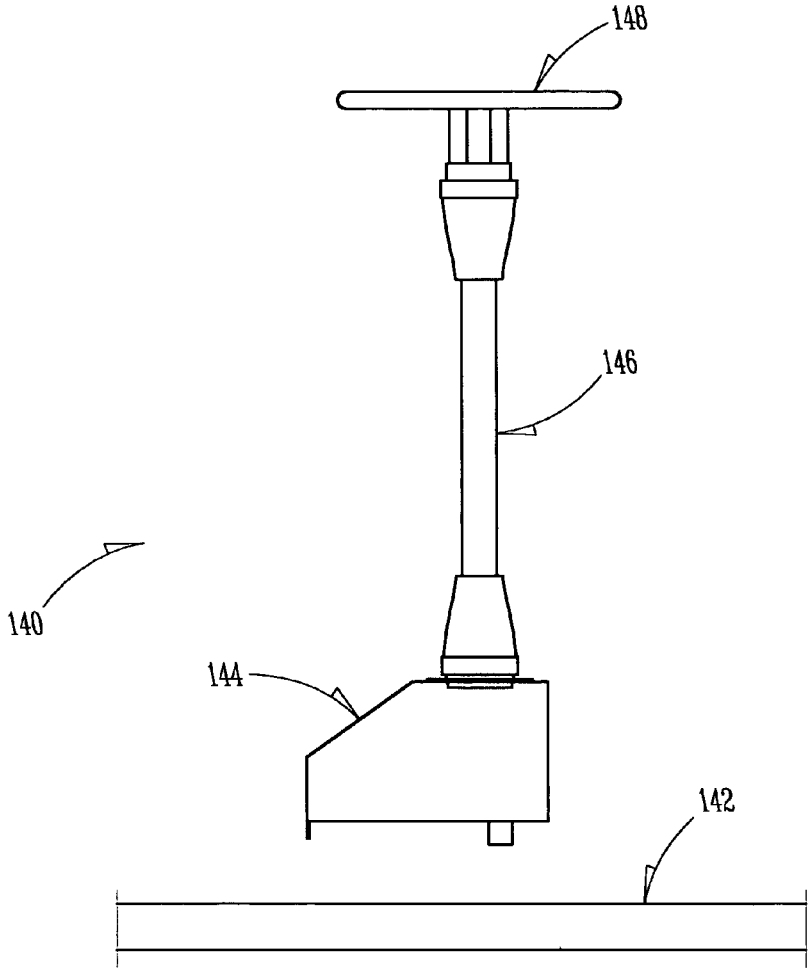
FIG. 15 is a side view in elevation of the sixth embodiment of FIG. 14.

Referring now to FIGS. 14 and 15, a sixth embodiment of the present invention is shown at 140. Again, the embodiment 140 includes a power track 142, a track head 144, an extension arm 146 and a display member 148. However, the device 140 differs from all of the other embodiments in that there is a fixed association between the track head 144, the extension arm 146, and the display member 148. Accordingly, if removal of the display member 148 is desired, the only way such removal can be accomplished is to remove the track head 144 from the power track 142.

As can be recognized from the above description, the present invention provides a novel, efficient and practical means for providing an electrical display that includes a plurality of individual display members. Although the display device of the present invention has been described with respect to six preferred embodiments, it should be understood that such embodiments may be altered without avoiding the true spirit and scope of the present invention. For example, a variety of different types of electrical connectors could be employed in forming the invention and a variety of shapes for the track head may also be utilized. It is also important to note that the use of individualized display members allows the display device to incorporate almost any type of particular term that is desired to be displayed and that a plurality of designs can also be formed by the present invention.

What is claimed is:

1. An electrical neon display device that allows for the interchangeability of the material being displayed, said device comprising:

(a) an alternating current power track;

(b) at least one neon track head that is removably attached and semi-permanently electrically connected to said track and housing a transformer for converting alternating current to direct current; and (c) at least one display member that is removably attached and semi-permanently electrically connected to said at least one track head.

2. The electrical neon display device as described in claim 1, wherein said device includes a plurality of individual display members removably attached and semipermanently electrically connected to a plurality of individual track heads.

3. The electrical neon display device as described in claim 2, wherein said display member includes a neon tube shaped in the configuration of a desired letter or design to be displayed by said device.

4. The electrical neon display device as described in claim 3, wherein said track head has one of a female electrical connector and a male electrical connector and said display member has an electrical connecting member opposite to that of the track head.

5. The electrical neon display device as described in claim 4, wherein said track head and said display member have coactive connecting means that are utilized to removably connect said track head and display member together.

6. The electrical neon display device as described in claim 5, wherein said connecting means further includes a latch member that is removably associated with said track head and said display member.

7. The electrical neon display device as described in claim 1, wherein said track head and display member are associated in a fixed relationship with one another to form a unitary member.

8. The electrical neon display device as described in claim 1, wherein said device further includes a rigid extension member that is disposed between said track head and said display member.

9. The electrical neon display device as described in claim 8, wherein said extension member has a flexible body portion to allow for the movement of said display member with respect to said power track.

10. The electrical neon display device as described in claim 9, wherein said extension member allows said display member to be pivoted at least ninety degrees with respect to said power track.

11. The electrical neon display device as described in claim 10, wherein said extension member is attached to said track head in a fixed relationship and said display member is removably attached and semi-permanently electrically connected to said extension member.

12. The electrical neon display device as described in claim 10, wherein said extension member is removably attached and semi-permanently electrically connected to said track head and said display member is attached to said extension member in a fixed relationship.

13. The electrical neon display device as described in claim 10, wherein said extension member is attached to said track head in a fixed relationship and said display member is attached to said extension member in a fixed relationship.

14. An electrical neon display device that allows for the interchangeability of the material being displayed, said device comprising:

(a) an alternating current power track;

(b) at least one neon track head that is removably attached and semi-permanently electrically connected to said track and housing a transformer for converting alternating current to direct current;

(c) at least one display member;

(d) a rigid extension member that is disposed between and connects said track head and said display member; and (e) said extension member has a flexible body portion to allow for the movement of said display member with respect to said power track.

15. The electrical neon display device as described in claim 14, wherein said extension member allows said display member to be pivoted at least ninety degrees with respect to said power track.

16. The electrical neon display device as described in claim 15, wherein said extension member is attached to said track head in a fixed relationship and said display member is removably attached and semi-permanently electrically connected to said extension member.

17. The electrical neon display device as described in claim 15, wherein said extension member is removably attached and semi-permanently electrically connected to said track head and said display member is attached to said extension member in a fixed relationship.

18. The electrical neon display device as described in claim 15, wherein said extension member is attached to said track head in a fixed relationship and said display member is attached to said extension member in a fixed relationship.

19. The electrical neon display device as described in claim 15, wherein said device includes a plurality of individual display members, a plurality of individual track heads, and a plurality of extension members disposed between and connecting the plurality of individual display members and the plurality of individual track heads.

20. The electrical neon display device as described in claim 19, wherein said display member includes a neon tube shaped in the configuration of a desired letter or design to be displayed by said device.

* * * * *